United States Patent [19]

Lunsford

[11] Patent Number: 5,005,891

[45] Date of Patent: Apr. 9, 1991

[54] BAG HANDLE APPARATUS

[76] Inventor: T. J. Lunsford, 11668 Hi Ridge Rd., Lakeside, Calif. 92040

[21] Appl. No.: 485,089

[22] Filed: Feb. 26, 1990

[51] Int. Cl.[5] ..... A45F 5/10; B65D 33/06

[52] U.S. Cl. ..... 294/171; 294/149; 383/13

[58] Field of Search ..... 294/137, 141–143, 294/149, 152, 153, 158, 165, 167, 170, 171; 16/110 R, 114 R, 114 B; 24/16 P, 16 B, 17 R, 17 A, 17 B, 17 AP, 30.5 P, 30.5 S; 190/39, 115–117; 220/94 R, 96; 229/117.09, 117.19; 383/6, 13, 24, 25, 29

[56] References Cited

U.S. PATENT DOCUMENTS

| | | | |
|---|---|---|---|
| 3,255,501 | 6/1966 | Laguerre | 24/16 PB |
| 3,315,324 | 4/1967 | Ward | 24/16 PB X |
| 3,318,354 | 5/1967 | Broisof | 24/16 PB X |
| 3,912,140 | 10/1975 | Franges | 294/171 X |
| 4,030,649 | 6/1977 | Potoroka | 294/149 |
| 4,558,896 | 12/1985 | Farnworth | 294/153 X |
| 4,796,940 | 1/1989 | Rimland | 294/171 |

FOREIGN PATENT DOCUMENTS

| | | | |
|---|---|---|---|
| 1076254 | 7/1967 | United Kingdom | 383/13 |
| 2132882 | 7/1984 | United Kingdom | 294/171 |
| 2135179 | 8/1984 | United Kingdom | 294/171 |

*Primary Examiner*—Johnny D. Cherry
*Attorney, Agent, or Firm*—David J. Harshman

[57] ABSTRACT

A bag handle apparatus comprises a thin sheet of semi-rigid flexible material having a locking tab formed on one end, and a locking slot formed in a second end of the sheet. A locking tab lockingly engages the locking slot to hold the bag handle apparatus in a generally arcuate shape about one or more bag handles which are loaded with articles. The sheet has a width sufficient to cover the palm of the user's hand and a length sufficient to be disposed around the desired number of bag handles. The sheet is preferably low density polyethylene having a thickness of from 0.060 to 0.090 inches.

7 Claims, 1 Drawing Sheet

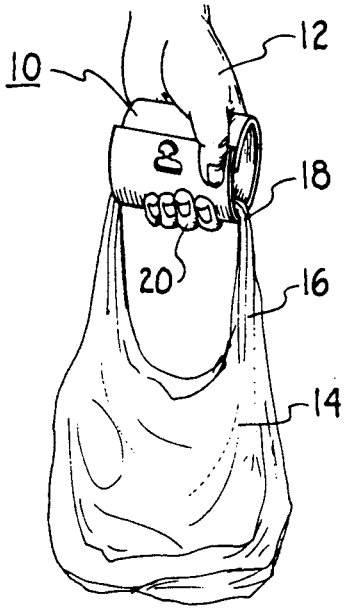
Fig. 1
Fig. 2
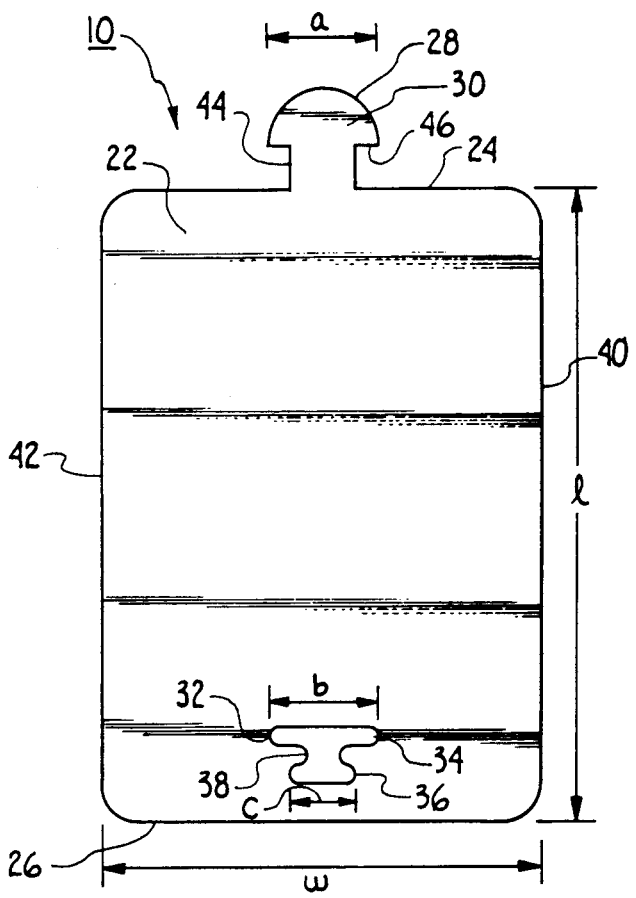
Fig. 4
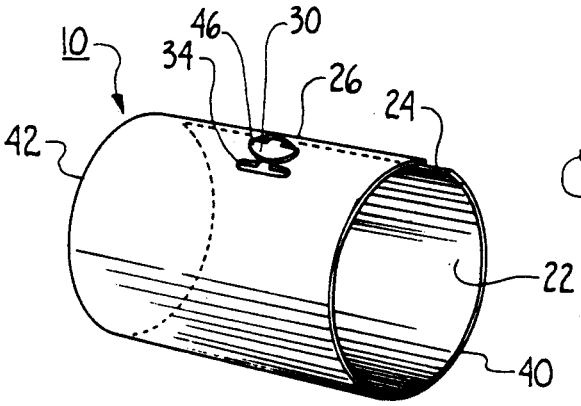
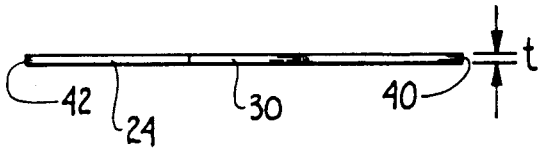
Fig. 3

BAG HANDLE APPARATUS

FIELD OF THE INVENTION

This invention relates generally to articles for carrying heavy loads. More specifically, the invention relates to an apparatus for protecting the hands of one carrying a bag having narrow handles. The present invention is particularly, though not exclusively, useful for allowing the user to carry one or more heavily loaded plastic grocery bags without causing discomfort to the user's hand.

BACKGROUND OF THE INVENTION

Articles for carrying various items have been in existence for many years. In retail establishments, bags are commonly provided to a purchaser of goods to carry the goods out of the retail establishment. In the past, such bags have been in the form of paper bags or sacks, and such paper bags were especially prevalent in grocery stores and supermarkets for bagging food and related sundry items. When paper bags are filled with a heavy load of goods, unfortunately, on occasion they rip or break, causing damage to goods as well as customer inconvenience. Recently, retail establishments have introduced bags made of plastic, in addition to or in place of paper bags. Such plastic bags are very light, yet very strong, and do not break easily, even when wet as do conventional paper bags. Such plastic grocery bags typically have a portion of the bag cut out which forms a pair of handles as a part of the light, yet strong plastic bag. As a consequence of the strength of the plastic bags, many retail establishments such as grocery stores and supermarkets, not concerned with breakage of the bag, are able to load a significant amount of items in the bag carrier. This is especially the case in establishments which sell food. For canned goods and liquid items such as milk, such bags can become very heavy. It is often desirable for the customer to carry at least one, and typically more than one of such plastic bags at the same time in carrying the goods from the customer's automobile or bus to his or her destination. Unfortunately, in situations where the bag is heavily loaded, which is often, the bag handles become taut. The handles become more likened to a string or wire which cuts across the user's hand and fingers, and which can become painful after a fairly short period of time. Therefore, although the user could carry the load without fear of breakage and save a number of trips, there is discomfort to the user's hand making it difficult to carry such bags for an appreciable distance.

Various attempts have been made to incorporate plastic handles into such shopping bags in an effort to distribute the load more evenly in a user's hand. In addition, various padding can be added to the bag handles, or the user can wear gloves. However, this can be costly, inconvenient, and may still cause discomfort in carrying such bags to the hands of the user. The present invention recognizes that providing a quick and convenient manner of distributing the load from the narrow plastic material handle to a wider area in the hand of the user would result in less discomfort and increased ease and effectiveness in carrying such loads. The present invention satisfies the need for providing protection for the hands of the user in a manner which is convenient to use and which accommodates the needs of the user.

Accordingly, it is an object of the present invention to provide a bag handle apparatus which protects the hands of a user carrying one or more heavily loaded plastic carrier bags. It is yet another object of the present invention to provide a bag handle apparatus which is durable and reliable in operation. Another object of the present invention is to provide a bag handle apparatus which can be quickly and easily incorporated for use with conventional plastic shopping bags. It is still another object of the present invention to provide a bag handle apparatus which is simple and convenient in its use, yet cost-effective in its manufacture.

SUMMARY OF THE INVENTION

A preferred embodiment of the bag handle apparatus comprises a thin sheet of semirigid flexible material. The sheet has a first end portion and a second end portion opposite the first end portion. A locking tab is formed on the first end portion, and a locking slot is formed in the second end portion. The locking tab is constructed to lockingly engage the locking slot. The sheet has a width sufficient to cover the palm of the user's hand, and has a length sufficient to permit the sheet to be wrapped around one or more bag handles so that the locking tab can be engaged in the locking slot. In a preferred embodiment, the sheet is made of low density polyethylene, and has a thickness in the range of from six one hundredths to nine one hundredths (0.060–0.090) inches.

The locking tab is constructed in a substantially mushroom shape and has a head portion that has a predetermined width. The locking slot is formed with a first orifice portion and a second orifice portion. The second orifice portion is positioned beneath the first orifice portion and separated therefrom by a flexible catch portion of the sheet. The first orifice portion has a width greater than the tab head to allow the tab to freely move into and out of the first orifice, and the second orifice portion has a width less than the tab head to latch the head in the second orifice to thus lock the tab in the slot.

The novel features of this invention, as well as the invention itself, both as to its structure and its operation, will be best understood from the accompanying drawings, taken in conjunction with the accompanying description, in which similar reference characters refer to similar parts, and in which:

BRIEF DESCRIPTION OF THE DRAWINGS

FIG. 1 is a perspective view of a bag handle apparatus shown as it is used in its intended environment;

FIG. 2 is a front view of the bag handle apparatus;

FIG. 3 is a top end view of the bag handle apparatus shown in FIG. 2; and FIG. 4 is a perspective view of the bag handle in its wrapped and locked position.

DESCRIPTION OF THE PREFERRED EMBODIMENT

In FIG. 1, there is shown a perspective view of a bag handle apparatus 10, being used in its intended environment. In particular, hand 12 of a user carries bag 14. Bag 14 is a flexible plastic carrier bag, such as a conventional grocery bag, which has handles 16 formed in the plastic carrier bag 14. Plastic carrier bag 14 is shown with its lower portion cut away, but it is contemplated for purposes of the present invention, as being heavily loaded with goods, such as canned goods, liquid goods or other heavy articles for which the present invention is most useful. A portion 18 of plastic material handle 16 is disposed across fingers 20 of user's hand 12. When bag 14 is heavily loaded, or if there are a plurality of similar bags being carried at the same time by user's hand 12, handle portion 18 which forms a part of plastic bag 14, becomes taut and very narrow. This action thus would tend to create large forces per unit of surface area on the user's fingers 20, which would otherwise tend to cut into fingers 20 of user's hand 12. As shown in FIG. 1, however, handle portion 18 is instead pressed onto bag apparatus 10. This action distributes the load carried in bag or bags 14 onto apparatus 10 and thus more evenly across fingers 20 of user's hand 12.

As further shown in FIGS. 2 and 3, bag handle apparatus 10 is comprised of a thin sheet 22 of semirigid flexible material. In the embodiment shown, sheet 22 is substantially rectangular in shape, having a first end portion 24 and second end portion 26. Sheet 22 has a length 1, and a width w. Width w is preferably a width sufficient to cover the palm or fingers of a user. In the embodiment shown, length 1 is approximately four (4) inches and width w is approximately three (3) inches. Sheet 22 is advantageously made of low density polyethylene so that it is strong and durable, yet flexible and deformable. Sheet 22 preferably has a thickness, as shown by the dimension t, in the range of from six one hundredths to nine one hundredths (0.060–0.090) inches. Formed on the first end portion 24 of sheet 22 is locking tab 28. Locking tab 28 has a substantially mushroom shape and includes a head portion 30, which head portion 30 has a width a. Formed in sheet 22 near second end portion 26 is a locking slot 32. Locking slot 32 includes a first orifice 34 having an overall clearance width b, and a second orifice 36 having an overall clearance width c. First orifice 34 is separated from second orifice 36 by a flexible catch portion 38 formed in sheet 22. Sheet 22 further includes a first edge 40 and a second edge 42. Width a of head portion 30 is less than width b of first orifice 34, but is greater than width c of second orifice 36. Orifice 36 is of sufficient width, however, to allow stem 44 of locking tab 28 to extend through orifice 36 so that abutment 46 can engage sheet 22 on the perimeter of orifice 36. This can perhaps best be appreciated with reference to FIG. 4.

In FIG. 4, there is illustrated bag handle apparatus 10 shown in its assembled and locked position. In particular, sheet 22 is arcuately deformed so that head 30 of locking tab 28 is inserted through first orifice 34, and then pulled back away from orifice 34. This causes stem 44 to move flexible catch portion 38 temporarily aside to position tab 28 in second orifice 36. Abutment 46 then engages sheet 22 on the perimeter of second orifice 36. This abutting engagement provides sufficient locking action to maintain bag handle apparatus 10 in the position substantially as shown in FIG. 4. Thus in operation, sheet 22 can be deformably wrapped around handle portion 18, and then conveniently locked in the shape as shown in FIG. 4. The sheet 22, being disposed about the handle portion 18, provides protection to the hand 12 of the user and protects the fingers 20 by distributing the load across sheet 22, rather than directly onto the user's fingers 20. Although not shown, a plurality of bags can be used, with the sheet 22 being disposed about a plurality of heavily loaded bag handles to provide protection for the hand 12 of the user. Bag handle apparatus 10 can conveniently be assembled for use as shown in FIG. 4. To disassemble bag handle apparatus 10 and return apparatus 10 to the flat position as shown in FIG. 2 for carrying and storage, the user simply presses down on stem portion 44. This snaps head portion 30 from second orifice 36 across flexible catch 38 into first orifice 34. Head portion 30 can then be released from first orifice 34. The bag apparatus 10 is simple and easy to use, yet provides protection for the user in carrying one or a plurality of plastic carrier bags.

While the particular bag handle apparatus as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. An apparatus for protecting the hands of a user carrying at least one heavily loaded plastic carrier bag of the type having handles formed in the plastic carrier bag, comprising:

a thin sheet of semirigid flexible material having a first end portion and a second end portion opposite said first end portion;

a locking tab formed on said first end portion; and a locking slot formed in said second end portion for lockingly engaging said locking tab, wherein said locking tab has a substantially mushroom-shaped head portion having a predetermined width, and said slot has a first orifice portion and a second orifice portion positioned beneath said first orifice portion so that said first orifice portion is disposed intermediate said second orifice portion and said locking tab, and separated by a flexible catch portion, said first orifice portion having a width greater than said head portion to allow free movement into and out of said first orifice portion, said second orifice portion having a width less than said head portion to latch said head portion in said second orifice portion, said sheet having a width sufficient to cover the user's hand, and having a length sufficient to permit said sheet to be disposed around said carrier bag handles with said locking tab engaged in said slot.

2. An apparatus as recited in claim 1, wherein said sheet is made of low density polyethylene, having a thickness in the range of from six one hundredths to nine one hundredths (0.060–0.090) inches.

3. An apparatus as recited in claim 2, wherein said width of said sheet is substantially ¾ said length of said sheet.

4. A method for protecting the hands of a user carrying at least one plastic carrier bag of the type having handles formed in the plastic carrier bag, comprising the steps of:

providing a thin flat sheet of rectangular flexible plastic material having a locking slot in one end of said sheet, and a locking tab at another end of said sheet engageable with said slot, wherein said locking tab has a substantially mushroom-shaped head portion having a predetermined width, and said slot has a first orifice portion and a second orifice portion positioned beneath said first orifice portion so that said first orifice portion is disposed intermediate said second orifice portion and said locking tab, and separated by a flexible catch portion, said first orifice portion having a width greater than said head portion to allow free movement into and out of said first orifice portion, said second orifice portion having a width less than said head portion to latch said head portion in said second orifice portion, disposing said sheet under said plastic carrier bag handles;

wrapping said sheet about said handles; and locking said tab into slot to lock said sheet about said handles.

5. A method as recited in claim 4, wherein said locking step includes inserting said tab into an orifice forming a part of said slot.

6. A method as recited in claim 4, further comprising the step of wrapping said sheet about the handles of a plurality of carrier bags.

7. A method as recited in claim 6, further comprising the step of unlocking and removing said sheet from said carrier bag handles.

* * * * *